US005242283A

United States Patent [19]

Mori et al.

[11] Patent Number: 5,242,283

[45] Date of Patent: Sep. 7, 1993

[54] SCROLL TYPE COMPRESSOR WITH ELONGATED DISCHARGE PORT

[75] Inventors: Tatsushi Mori; Tetsuhiko Fukanuma; Yuji Izumi; Tetsuo Yoshida, all of Kariya, Japan

[73] Assignee: Kabushiki Kaisha Toyoda Jidoshokki Seisakusho, Kariya, Japan

[21] Appl. No.: 849,173

[22] Filed: Mar. 10, 1992

[30] Foreign Application Priority Data

Mar. 15, 1991 [JP] Japan ..... 3-15427[U]
Jan. 30, 1992 [JP] Japan ..... 4-15004

[51] Int. Cl.[5] ..... F04C 18/04
[52] U.S. Cl. ..... 418/55.2; 418/183
[58] Field of Search ..... 418/55.1, 55.2, 183

[56] References Cited

U.S. PATENT DOCUMENTS 4,571,137 10/1985 Terauchi et al. ..... 418/55.2
4,604,039 8/1986 Terauchi ..... 418/55.1
4,781,549 11/1988 Caillat ..... 418/55.2
5,056,336 10/1991 Harrison ..... 418/55.2

FOREIGN PATENT DOCUMENTS 59-58187 4/1984 Japan .
59-60093 4/1984 Japan .
59-218380 12/1984 Japan .
1106987 4/1989 Japan ..... 418/55.1
1187390 7/1989 Japan ..... 418/55.2
2169886 6/1990 Japan ..... 418/55.2

*Primary Examiner*—John J. Vrablik
*Attorney, Agent, or Firm*—Brooks Haidt Haffner & Delahunty

[57] ABSTRACT

An improved scroll type compressor having enlarged fixed and orbiting spiral element tips with parallel flat faces is disclosed. A discharge port for discharging compressed fluids is positioned in the fixed end plate. The discharge port is shaped to provide an opening that is effectively elongated adjacent the flat face of the fixed spiral element. In one preferred embodiment, the discharge port has a pair of elongated sides that extend in parallel with the flat face of the fixed spiral element. Another preferred embodiment the discharge port includes a plurality of holes arranged such that a common tangent to the perimeter of the holes is substantially parallel to the flat face of the fixed spiral element. A tapered surface may also be provided in the flat face of the enlarged tip of the orbiting spiral element to improve communication between the compression chamber and the discharge port.

13 Claims, 10 Drawing Sheets

SCROLL TYPE COMPRESSOR WITH ELONGATED DISCHARGE PORT

BACKGROUND OF THE INVENTION

1. Field of the Invention

The present invention relates to a scroll type compressor provided with a fixed scroll and an orbiting scroll. More particularly, it relates to an improved scroll tip and discharge port arrangement.

2. Description of the Related Art

Japanese Unexamined Patent Publication No. 59-218380 discloses a compressor as shown in FIGS. 13 to 15. This compressor has a fixed scroll 91 fixed in a housing 90 and an orbiting scroll 92. The orbiting scroll 92 is supported revolvable around the axis of the fixed scroll 91 in the housing 90.

The fixed scroll 91 comprises a fixed end plate 911 and a fixed spiral element 912 formed integrally with the bottom surface of the fixed end plate 911. The fixed spiral element 912 has its inner and outer walls formed along involute curves. Likewise, the orbiting scroll 92 comprises an orbiting end plate 921 and an orbiting spiral element 922 formed integrally with the top surface of the orbiting end plate 921. The orbiting spiral element 922 also has its inner and outer walls formed along involute curves. The fixed spiral element 912 and the orbiting spiral element 922 slide against each other.

In this compressor, a drive shaft 95 rotates by the interaction of a stator 93 and a rotor 94 mounted on the drive shaft 95. As the drive shaft 95 rotates, the orbiting scroll 92 revolves around the axis of the fixed scroll 91 by the work of an eccentric pin 95*a* slightly eccentric to the drive shaft 95 and a rotation preventing device 96. In accordance with this revolution, a plurality of compression chambers 97 to be formed in a sealed state between the fixed scroll 91 and the orbiting scroll 92 move toward the center of the fixed scroll 91 while sequentially reducing their volumes.

A discharge port 98 is provided in the center of the fixed end plate 911. As shown in FIGS. 13 and 14, the fully compressed gas in a compression chamber 971 is discharged through the discharge port 98 into a discharge chamber 99. As the orbiting scroll 92 revolves, the fluid in the next compression chamber 972 (which follows the compression chamber 971) is sequentially discharged from the discharge port 98.

As shown in FIGS. 14 and 15, a tapered surface 922*b* is cut in a tip portion 922*a* in the center of the orbiting spiral element 922. This tapered surface 922*b* and the inner wall of a center tip portion 912*a* of the fixed spiral element 912 constitute a passage that permits communication between the compression chamber 971 in the final compression stage and the discharge port 98. The existence of this passage reduces the discharge resistance at the time the gas in the compression chamber 971 is discharged through the discharge port 98 into the discharge chamber 99.

In the conventional compressor, the end portions of the fixed spiral element 912 and orbiting spiral element 922 slide against the end plates of the mating scrolls while being pressed together in order to form sealed compression chambers. Both tip portions 912*a* and 922*a* receive the pressure of the gas in the most compressed state at the final compression state. Those tip portions 912*a* and 922*a* should therefore have a sufficient strength.

The formation of the tapered surface 922*b* at the end position of the tip portion 922*a* however decreases the strength of the tip portion 922*a* significantly. The tip portion 922*a* may therefore be damaged by the sliding action against the tip portion 912*a* and the high pressure. Because of these drawbacks, it is very difficult to use this type of tip design in a scroll type compressors for vehicles, which is required to operate under the conditions of fast rotation and high compression.

Further, in the conventional compressor, the compressed gas in the compression chamber 971 is discharged to the discharge port 98, passing through an opening enclosed by the circular inner wall of the discharge chamber 98 and the curved inner wall or the tip portion 922*a* of the orbiting spiral element 922. As the orbiting scroll 92 revolves, the tip portion 922*a* of the orbiting spiral element 922 gradually reduces the cross-sectional area of the passage between the discharge port 98 and the compression chamber 971.

Immediately before completion of the gas discharging, the cross-sectional area of the passage between the discharge port 98 and the compression chamber 971 decreases rapidly. Even if the tapered surface 922*b* is provided at the tip portion 922*a*, the discharge resistance will not be reduced sufficiently immediately before completion of the gas discharging when such reduction is needed most.

Furthermore, to optimize compression efficiency, it is desirable that the following compression chamber 972 does not communicate with the discharge port simultaneously with the compression chamber 971. This is because the compressed gases exiting compression chamber 971 would expand into the following chamber. The re-expansion reduces the compression efficiency.

SUMMARY OF THE INVENTION

Accordingly, it is a primary objective of the present invention to provide a compressor which can ensure sufficient strength for the center tip portions of fixed and orbiting scrolls, and can effectively decrease the discharge resistance of a compressed fluid while maintaining an effective compression efficiency.

To achieve the foregoing and other objects and in accordance with the purpose of the present invention, an improved scroll type compressor is provided. The compressor includes a fixed scroll having a fixed end plate and a fixed spiral element. The fixed spiral element includes a thick fixed tip portion having a flat face on an inner wall side. An orbiting scroll including an orbiting end plate and an orbiting spiral element is mounted for orbital revolving movement relative to the fixed scroll. The orbiting spiral element includes a thick orbital tip portion having a flat face on an inner wall side that faces the flat face of the fixed spiral element. The orbiting spiral elements are interleaved such that the flat faces of the fixed and orbital tip portions are periodically positioned adjacent each other during revolution of the orbiting scroll. The interleaved spiral elements define at least one airtight compression chamber between the fixed scroll and the orbiting scroll. A discharge port for discharging fluids from the compression chamber is positioned in the fixed end plate. The discharge port is shaped to provide an opening that is effectively elongated adjacent the flat face of the fixed spiral element.

In one preferred embodiment, the discharge port has a pair of elongated sides that extend in parallel with the flat face of the fixed spiral element. Another preferred embodiment the discharge port includes a plurality of holes arranged such that a common tangent to the perimeter of the holes is substantially parallel to the flat face of the fixed spiral element.

A tapered surface or bevel is provided contiguous with the flat face of the orbiting spiral element on the thick tip portion of the orbiting spiral element to improve communication between the compression chamber and the discharge port.

BRIEF DESCRIPTION OF THE DRAWINGS

The invention, together with objects and advantages thereof, may best be understood by reference to the following description of the presently preferred embodiments together with the accompanying drawings in which:

FIG. 1 is a longitudinal cross section of a scroll type compressor in accordance with a first embodiment of the present invention.

FIG. 2 is a cross-sectional end view of the tip portions of the fixed and orbiting scrolls taken along line 2—2 in FIG. 1.

FIG. 3 is a cross-sectional side view of the tip portions of the fixed and orbiting scrolls in the state shown in FIG. 2.

FIG. 4 is a diagram showing the orbiting scroll slightly advanced from the state in FIG. 2.

FIG. 5 is a diagram showing the orbiting scroll further advanced from the state in FIG. 4 so that the flat faces of the fixed and orbiting scrolls contact one another.

FIG. 6 is a perspective view showing the tip portion of the fixed scroll.

FIG. 7 is a perspective view showing the tip portion of the orbiting scroll.

FIG. 8 is a cross-sectional end view of the tip portions of the fixed and orbiting scrolls and corresponds to FIG. 2.

FIG. 9 is a cross-sectional side view of the tip portions of the fixed and orbiting scrolls in the state shown in FIG. 8.

FIG. 10 is a diagram showing the orbiting scroll advanced from the state in FIG. 8 so that the flat faces of the fixed and orbiting scrolls contact one another.

FIG. 11 is a perspective view showing the tip portion of the fixed scroll.

DETAILED DESCRIPTION OF THE PREFERRED EMBODIMENTS

First Embodiment

Figure 1:
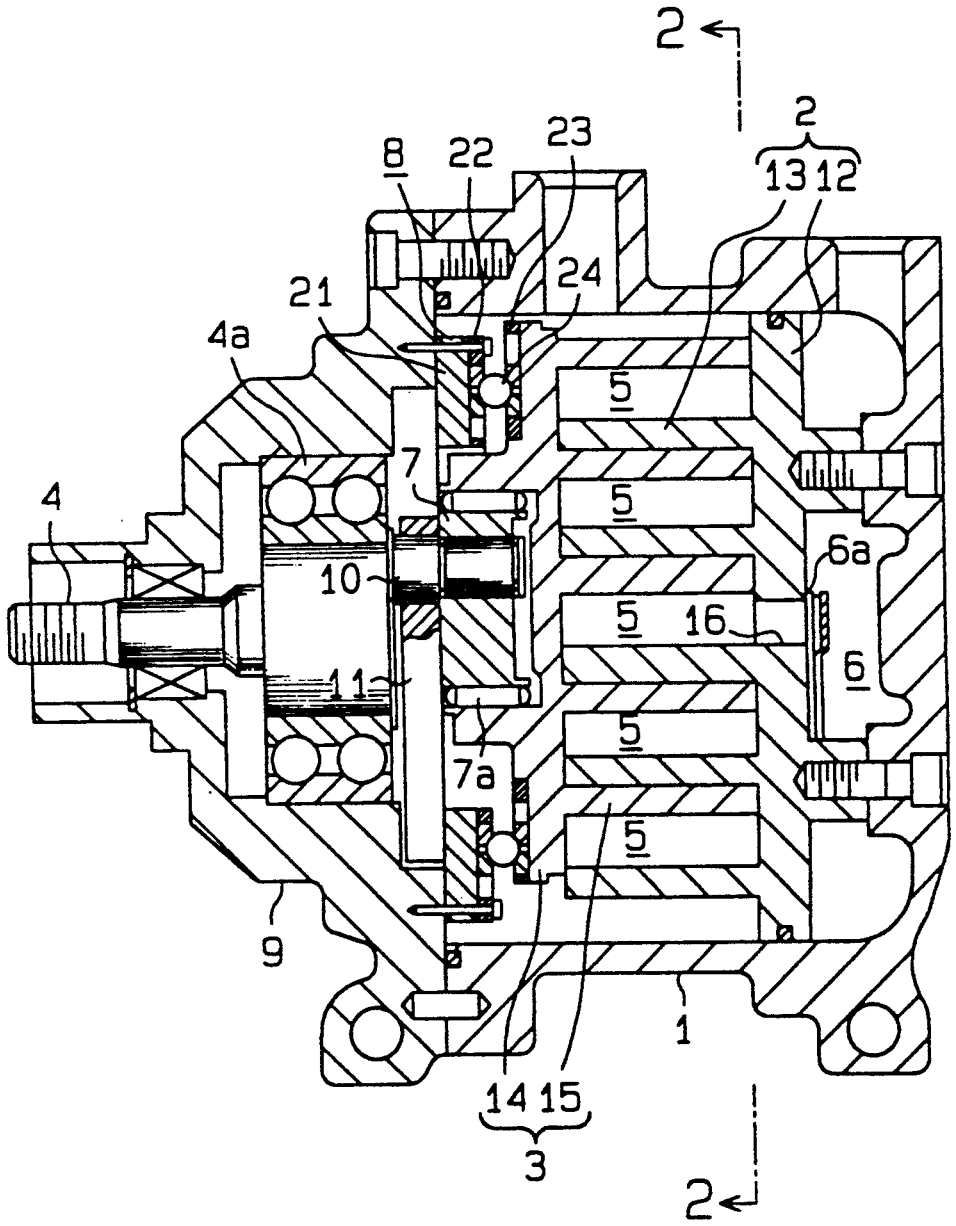
FIGS. 1 through 7 illustrate a first embodiment of the present invention. More specifically.

A first embodiment of the present invention will now be described referring to FIGS. 1 through 7. As shown in FIG. 1, a scroll type compressor has a pair of housings 1 and 9 which are to be connected together. In the housing 1, a fixed scroll 2 is fixed and a orbiting scroll 3 is provided.

The fixed scroll 2 includes a disk-shaped fixed end plate 12, and a fixed spiral element 13 formed integrally with the orbiting scroll side of that end plate 12. Likewise, the orbiting scroll 3 includes a disk-shaped orbiting end plate 14, and an orbiting spiral element 15 formed integrally with the fixed scroll side of that end plate 14. As both spiral elements 13 and 15 slide against each other, a plurality of compression chambers 5 are formed between the scrolls 2 and 3.

In the housings 1 and 9, a drive shaft 4 is supported via a radial bearing **4*a*. An eccentric pin 10 eccentric to the axis of the drive shaft 4 is provided at the end portion of the drive shaft 4. A counter weight 11 is secured to the proximal end side of the eccentric pin 10. A bushing 7 is fitted on the free end of the eccentric pin 10. The orbiting scroll 3 is supported on the bushing 7 via a bearing 7*a***.

A fixed ring 22 is secured on a base plate 21, facing the orbiting scroll 3, with an orbiting ring 23 secured to the back of the orbiting scroll 3. A plurality of circular revolution position regulating holes are bored at equal intervals in the fixed ring 22 and orbiting ring 23. The position regulating holes are arranged in facing pairs and a transmission shoe 24 is provided between each facing pair of position regulating holes.

The base plate 21, fixed ring 22, orbiting ring 23 and transmission shoes 24 constitute a rotation preventing device 8. The action of the rotation preventing device 8 allows the orbiting scroll 3 to revolve without rotation as the eccentric pin 10 revolves.

Figure 2:
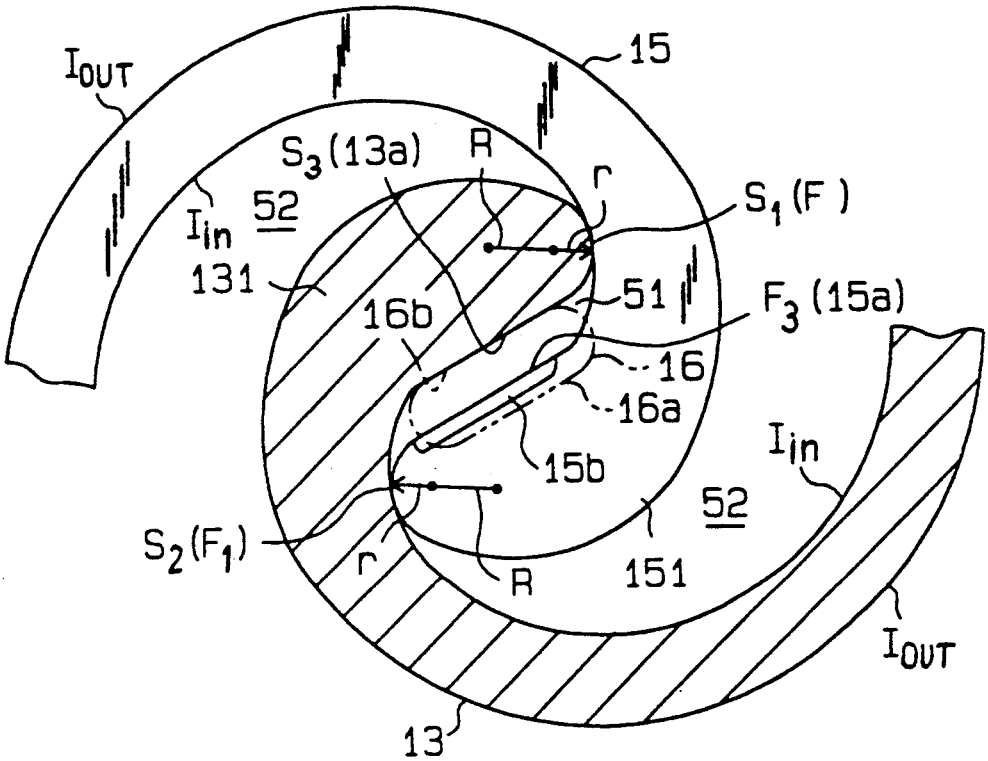

As shown in FIG. 2, the inner and outer walls of the fixed spiral element 13, excluding the inner wall side of a center tip portion 131 of the fixed spiral element 13, are formed along inner and outer involute curves $I_{in}$ and $I_{out}$ drawn based on a predetermined involute generating circle. Further, the inner outline of the fixed spiral element 13 at the tip portion 131 is determined along a circular arc $S_1$ with a radius r, a circular arc $S_2$ with a radius R ($R=r+q$; wherein q is the radius of revolution of the orbiting scroll 3) and a common tangent $S_3$ to these circular arcs $S_1$ and $S_2$.

Figure 3:
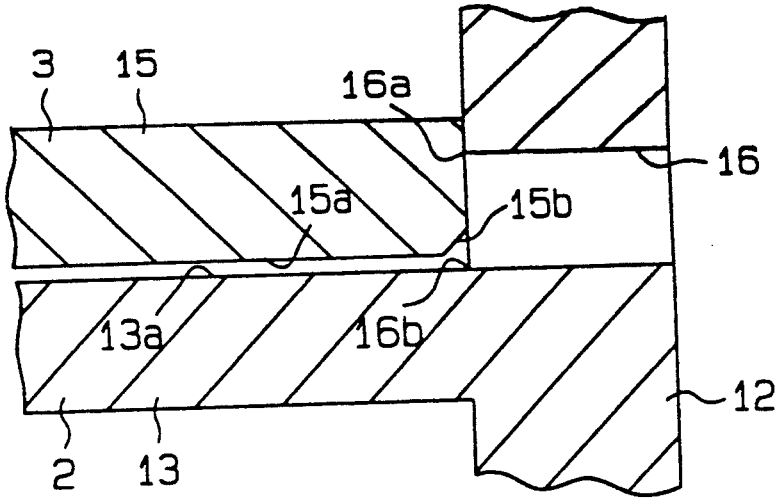
Figure 6:
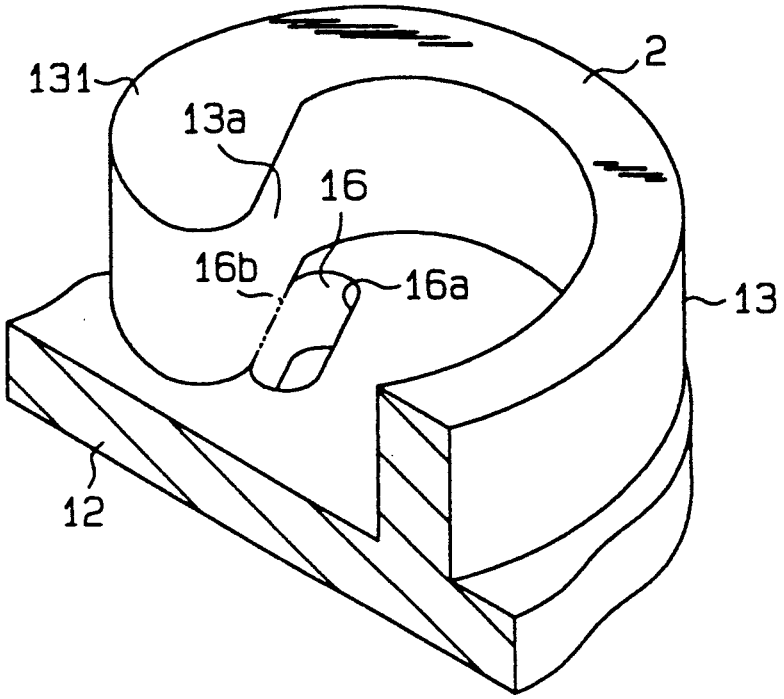

As shown in FIGS. 2, 3 and 6, therefore, the tip portion 131 of the fixed spiral element 13 is made thicker than the tip portion **912*a* of the conventional fixed spiral element 912. A flat face 13*a* constituting one part of the inner wall of the fixed spiral element 13 is formed at that part of the tip portion 131** which corresponds to the common tangent $S_3$.

As shown in FIGS. 2 and 6, an elongated oval or racetrack shaped discharge port 16 is formed through the fixed end plate 12. The discharge port 16 has linear elongated sides **16*a* and 16*b* that are substantially parallel to the common tangent $S_3$. The discharge port 16 is provided adjacent to the flat face 13*a* so that one of the elongated sides, 16*b*, of the discharge port 16 adjoins the flat face 13*a*. Part of the inner wall of the discharge port 16 is therefore linked straight to the flat face 13*a***.

Since the sides **16*a* and 16*b* are somewhat elongated, the discharge port 16 has nearly the same opening area as the circular discharge port 98** provided in the conventional compressor having the same size as the compressor of this embodiment.

As shown in FIG. 2, like the inner and outer walls of the fixed spiral element 13, those of the orbiting spiral element 15, excluding the inner wall side of a center tip portion 151 of the orbiting spiral element 15, are formed along the inner and outer involute curves $I_{in}$ and $I_{out}$ drawn based on a predetermined involute generating circle. Further, the inner outline of the orbiting spiral element 15 at the tip portion 151 is determined along a circular are $F_1$ with a radius r, a circular arc $F_2$ with a radius R ($R=r+q$; wherein q is the radius of revolution of the orbiting scroll 3) and a common tangent $F_3$ to these circular arcs $F_1$ and $F_2$.

Figure 7:
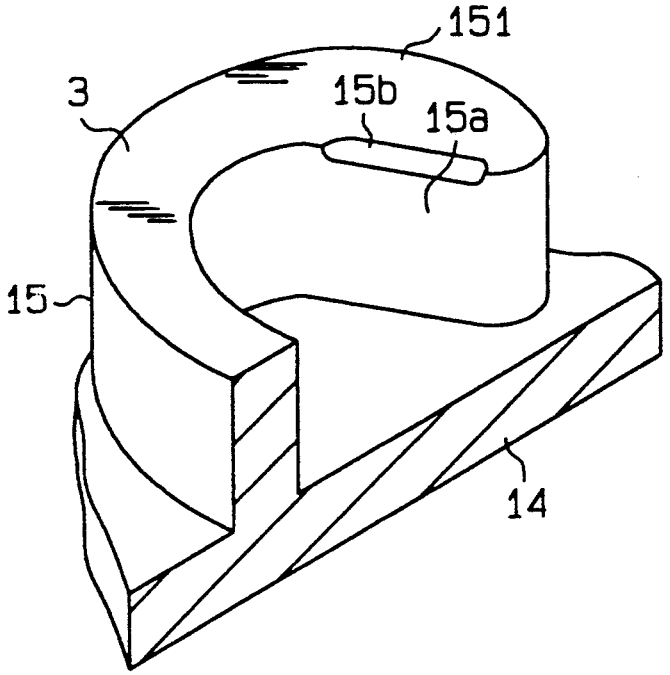

Therefore, as shown in FIGS. 2, 3 and 7, the tip portion 151 of the orbiting spiral element 15 is thicker than the tip portion 922*a* of the conventional orbiting spiral element 922. A flat face 15*a* constituting one part of the inner wall of the orbiting spiral element 15 is formed at the part of the tip portion 151 which corresponds to the common tangent $F_3$.

Since the tip portions 131 and 151 of the fixed spiral element 13 and orbiting spiral element 15 are made thicker, they are considerably stronger than those of the conventional fixed and orbiting spiral elements.

As the circular arcs $S_1$ and $S_2$ on the fixed spiral element side contact the circular arcs $F_2$ and $F_1$ on the orbiting spiral element side, a compression chamber 51 is formed as shown in FIG. 2. As the orbiting scroll 3 revolves, the flat face 13*a* of the fixed spiral element 13 periodically comes into close contact with the flat face 15*a* on the orbiting spiral element side as shown in FIG. 5.

As shown in FIGS. 2, 3 and 7, a tapered or beveled surface 15*b* is cut in the flat face of the tip portion 151 of the orbiting spiral element 15. The tapered surface is approximately the same length as the elongated sides 16*a* and 16*b* of the discharge port 16. The taper in tip portion 151 forms a narrowed neck therein. However, since the tip portion 151 is rather thick, it has a sufficient strength in its neck region. Therefore, the formation of the tapered surface 15*b* does not impair the strength of the tip portion 151.

Figure 5:
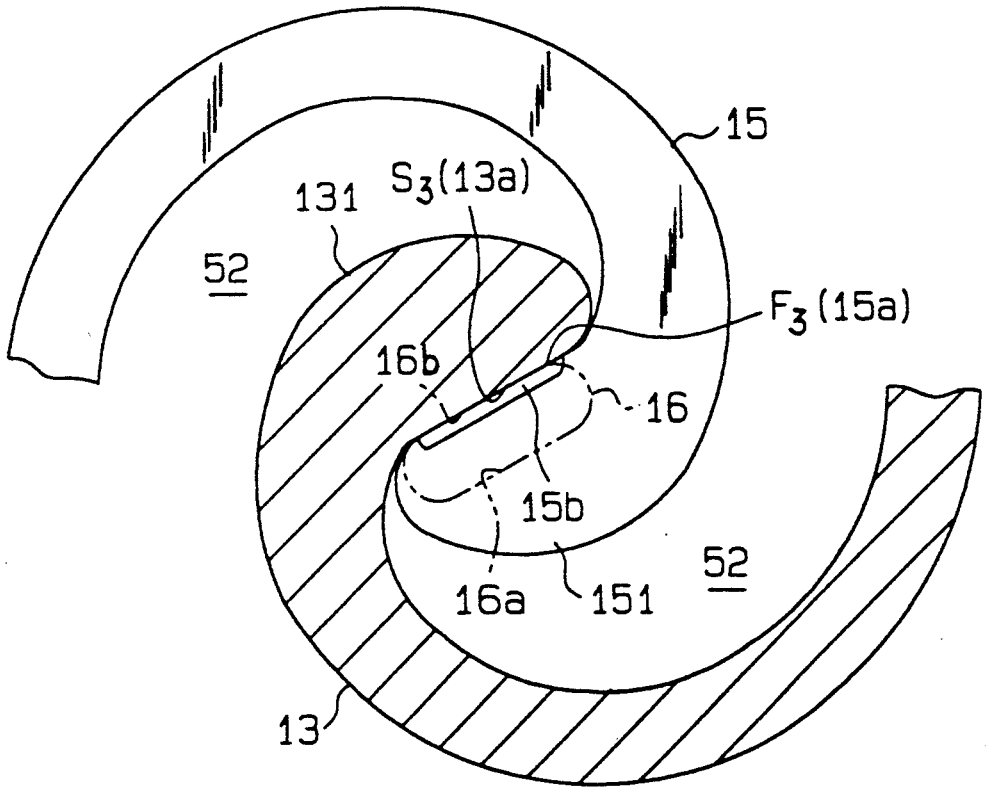

At the time the opposite flat faces 13*a* and 15*a* contact each other, the discharge port 16 is almost completely covered with the thick tip portion 151 as shown in FIG. 5. At this time the tapered surface 15*b* secures a passage between itself and the inner wall of the fixed spiral element 13 to permit communication of the compression chamber 5 with the discharge port 16.

Meanwhile, when this scroll type compressor is used as a compressor for a vehicular air conditioning, the drive shaft 4 is coupled to the driving system of the engine of a vehicle through an electromagnetic clutch (not shown). When the drive shaft rotates in accordance with the rotation of the engine, the rotation of the drive shaft 4 is transmitted via the pin 10, the bushing 7 and the rotation preventing device 8 to the orbiting scroll 3. The orbiting scroll 3 then revolves around the axis of the fixed scroll 2.

In accordance with the revolution of the orbiting scroll 3, the orbiting spiral element 15 gradually reduces the volume of the compression chamber 51 to the final compression stage. The compressed refrigerant gas pushes open a discharge valve 6*a* that is provided outside the discharge port 16. The compressed gases are thus discharged into the discharge chamber 6.

Figure 4:
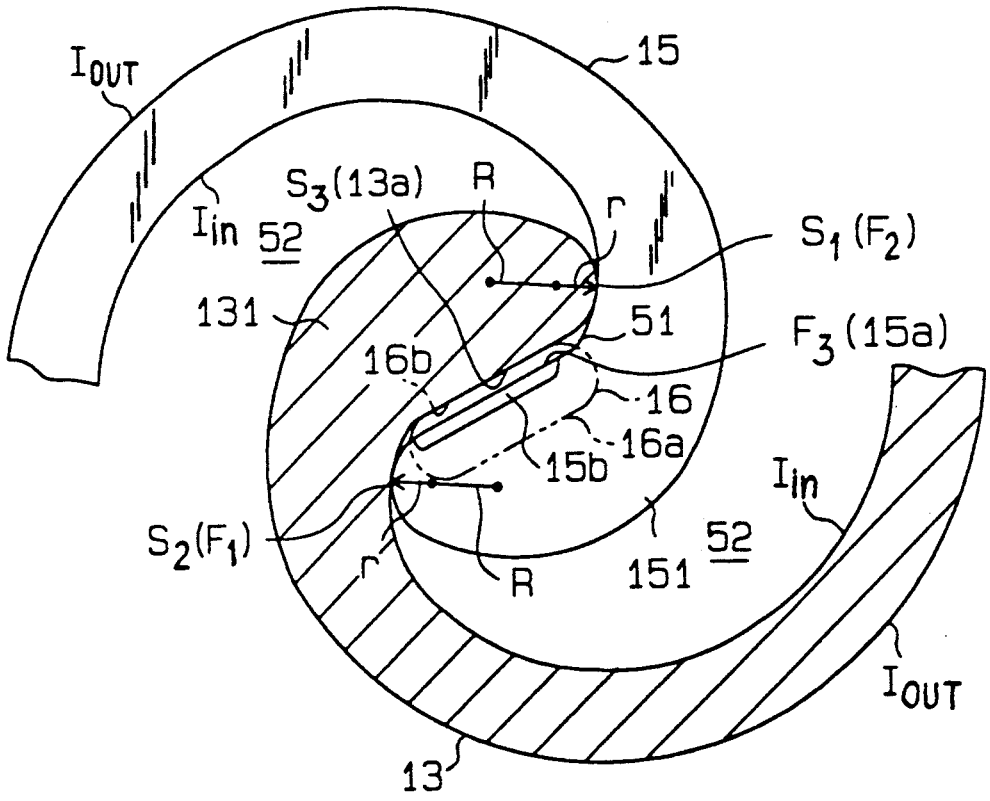

As is apparent from FIG. 2, the flat face 15*a* of the orbiting spiral element 15 becomes almost parallel to the flat face 13*a* of the fixed spiral element 13 and the elongated sides 16*a* and 16*b* of the discharge port 16 in the compression chamber 51 in the final compression stage. When the orbiting scroll 3 revolves further, most of the discharge port 16 is covered by the tip portion 151 as shown in FIG. 4. At this time the compressed refrigerant gas is discharged into the discharge chamber 6 through an elongated gap enclosed by the elongated side 16*b* of the discharge port 16 and the flat face 15*a* of the orbiting spiral element 15.

According to this embodiment, the gap through which the refrigerant gas passes is rather elongated due to the elongated side 16. The is true even when the opening area of this gap gradually decreases in accordance with the revolution of the orbiting scroll 3. Therefore, the cross-sectional area of the communication path between the discharge port 16 and the compression chamber 51 is larger than the corresponding communication path in conventional circular designs at any point of time before the discharging of the compressed gas is completed.

The tapered surface 15*b* formed on the orbiting spiral element 15 and the inner wall of the fixed spiral element 13 define a passage that permits communication between the compression chamber 51 and the discharge port 16 when the opposing flat faces 13*a* and 15*a* come in close contact with each other. The presence of this passage can greatly reduce the discharge resistance of the compressed gas from the compression chamber 51 to the discharge port 16.

According to this embodiment, after the refrigerant gas in the final compression stage is discharged into the discharge chamber 6 smoothly and surely, the following compression chamber 52 from the next cycle merges with the remnants of compression chamber 51 as the orbiting tip pulls away from the fixed tip. However since only a nominal amount of gas remains in compression chamber 51 reexpansion of compressed gas is effectively minimized or eliminated.

This action provides a good compression efficiency. It also prevents an excessive-pressure load from acting on the tip portions 131 and 151 of the fixed and orbiting spiral elements 13 and 15 for a long period of time, thus reducing the wear to spiral elements 13 and 15.

As shown in FIG. 5, when the flat face 13*a* of the fixed spiral element 13 closely contacts the flat face 15*a* of the orbiting spiral element 15, the tip portion 151 of the orbiting spiral element 15 almost covers the discharge port 16, except that portion which corresponds to the tapered surface 15*b*. The compression chamber 51 in the previous cycle will not communicate with the compression chamber 52 in the next cycle via the discharge port 16 before the compression chamber 51 in the final compression stage completes the gas discharge.

Second Embodiment

A description of the second embodiment of the present invention will be given below referring to FIGS. 8 through 11, mainly discussing the differences from the first embodiment.

Figure 8:
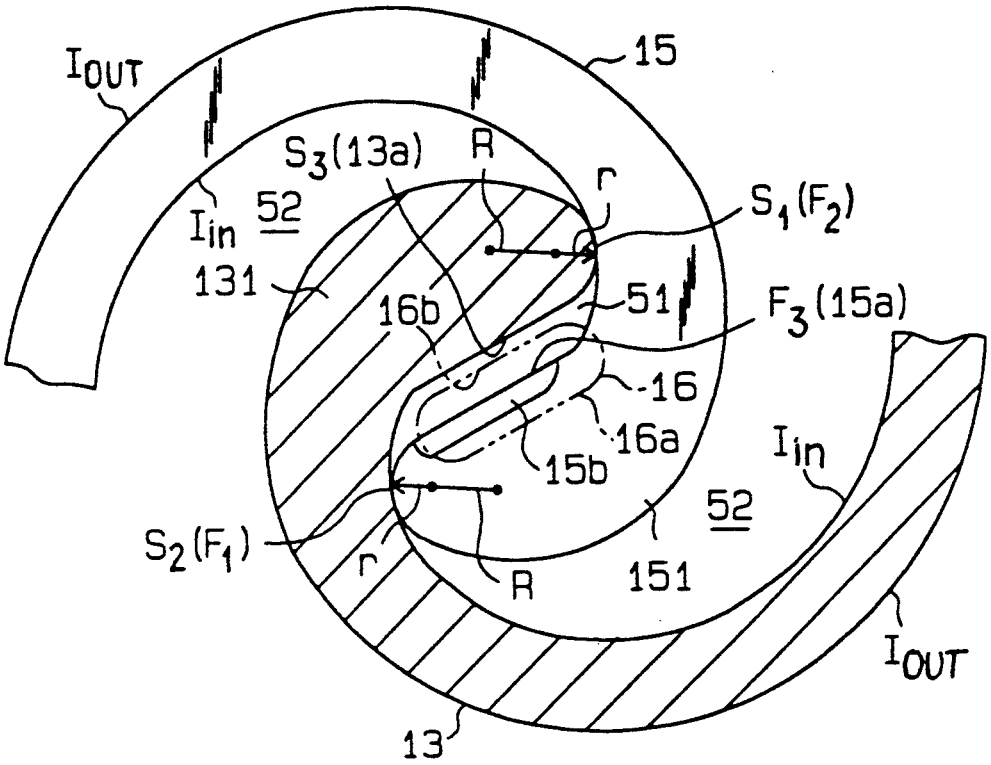
FIGS. 8 through 11 illustrate a second embodiment of the present invention. More specifically.
Figure 9:
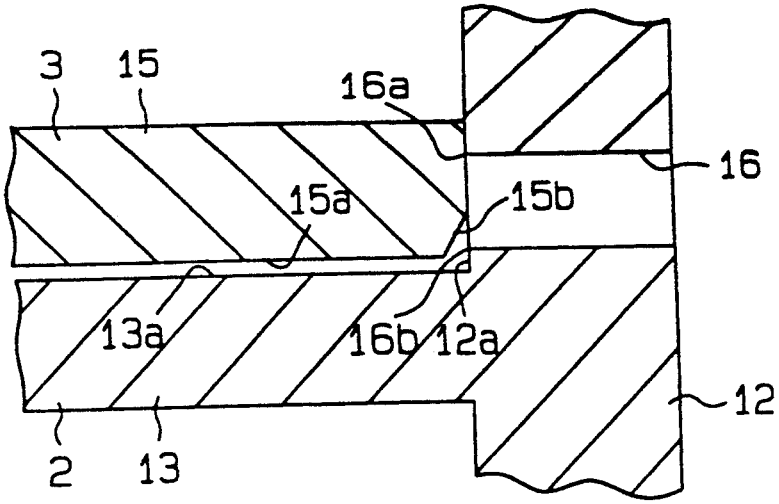
Figure 11:
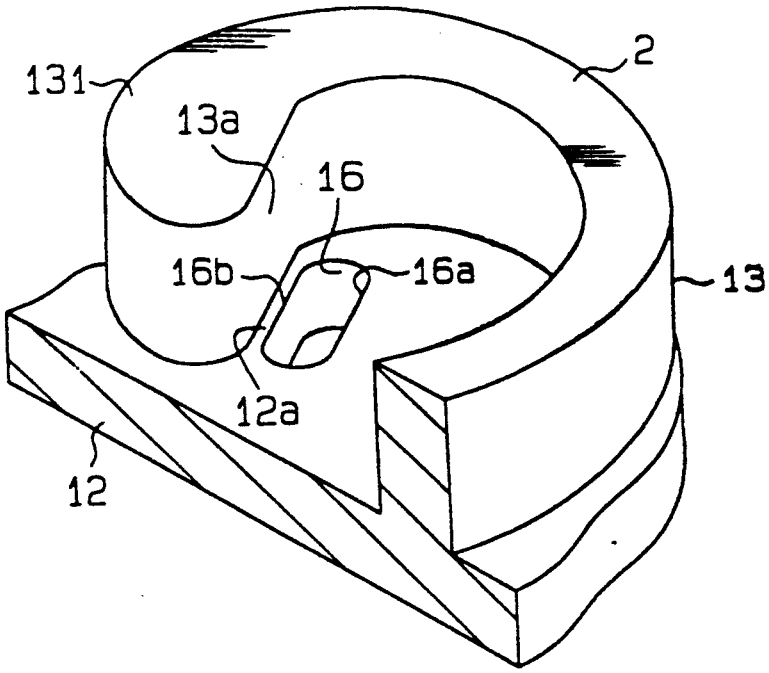

This embodiment differs from the first embodiment in the location of the discharge port 16. More specifically, as shown in FIGS. 8, 9 and 11, the discharge port 16 bored through the fixed end plate 12 is located slightly apart from the flat face 13*a* of the fixed spiral element 13. Accordingly, the flat face 13*a* is linked to the inner wall of the discharge port 16 via a step 12*a*.

Like the first embodiment, the discharge port 16 has an elongated oval or racetrack shape, and has linear elongated sides 16*a* and 16*b* parallel to the flat face 13*a* of the fixed spiral element 13. Since the sides 16*a* and 16*b* are elongated to some extent, the opening area of the discharge port 16 is secured as in the case of the first embodiment.

Figure 10:
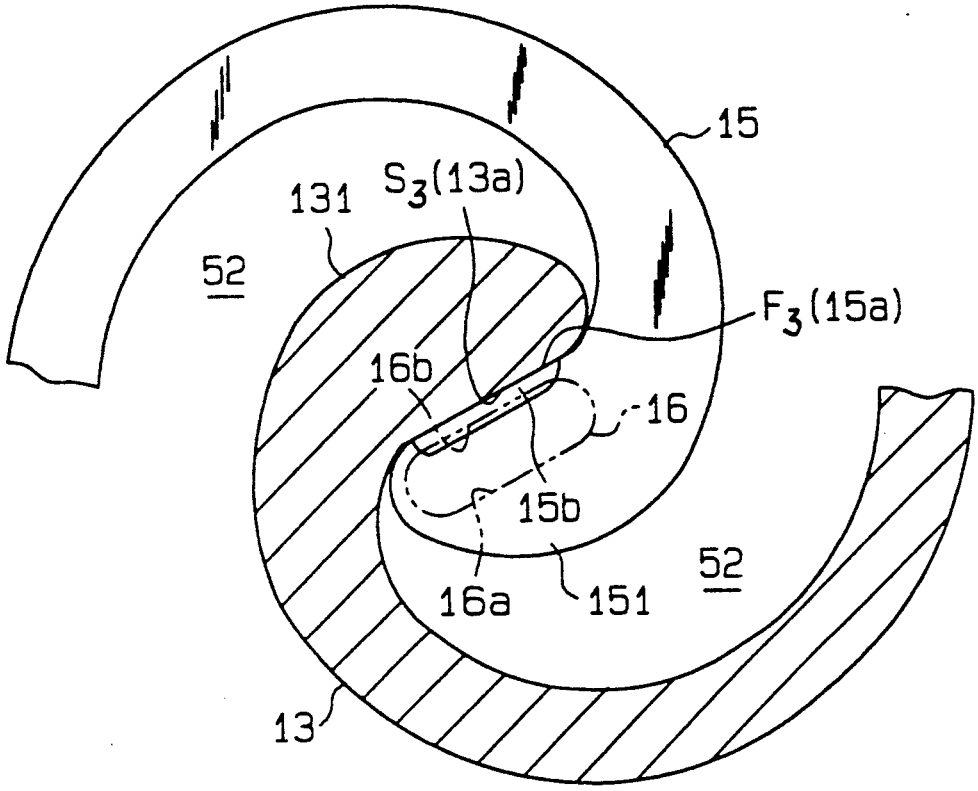

The second embodiment also has a tapered surface 15*b* cut into the end portion of the tip portion 151 of the orbiting spiral element 15. The tapered surface extends nearly the same length as the elongated sides 16*a* and 16*b* of the discharge port 16. It is noted, however, that the size and the inclination angle of the tapered surface 15*b* are determined in such a way that a passage for communication between the compression chamber 51 and discharge port 16 can be secured between the tapered surface 15*b* and the inner wall of the fixed spiral element 13 and the step 12*a* even when both flat faces 13*a* and 15*a* come into close contact with each other as shown in FIG. 10.

In the first embodiment, the discharge port 16 is provided adjacent to the tip portion 131 of the fixed spiral element 13 so that the inner wall of the discharge port 16 is effectively an extension of the flat face 13*a* of the fixed spiral element 13. With this arrangement, the narrowed or neck portion of the tip 131 (adjacent the taper) is the weakest portion and is most easily damaged. On the other hand, in the second embodiment, the discharge port 16 is formed slightly apart from the flat face 13*a* of the fixed spiral element 13 with the step 12*a* being positioned there between. This step 12*a* improves the strength of the neck portion of the tip 131. This improved strength effectively prevents the tip portion 131 from breaking at the neck.

The structures of the other portions of the second embodiment are quite the same as those of the first embodiment. The compressor according to the second embodiment therefore has all the advantages of the compressor of the first embodiment, such as securing the strength of the tip portions 131 and 151 of both spiral elements, securing the cross-sectional area of the passage between the discharge port 16 and compression chamber 51 in the final compression stage, the reduction of the discharge resistance and the prevention of the reduction in the compression efficiency.

Figure 12:
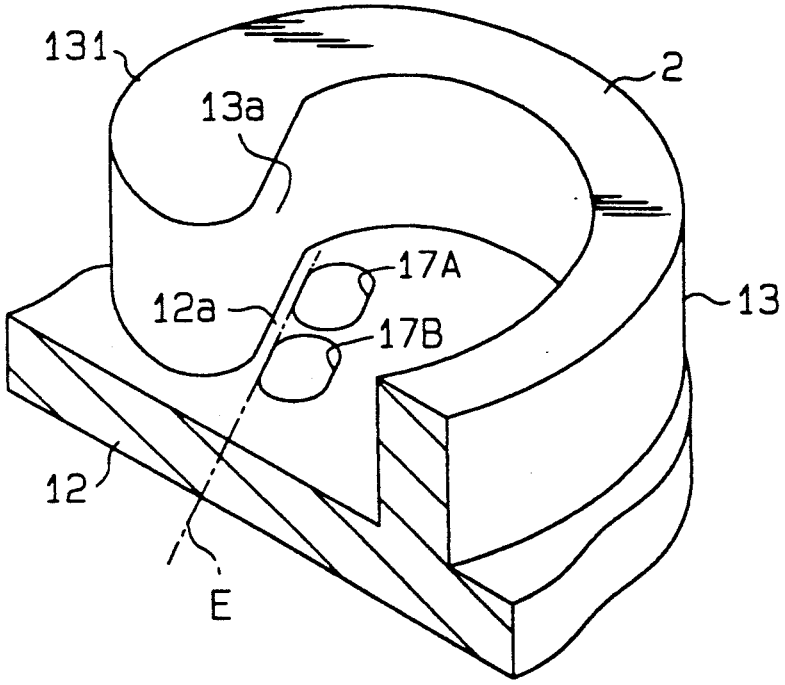
FIG. 12 is a diagram showing a modification of the present invention and corresponding to FIG. 11.
Figure 13:
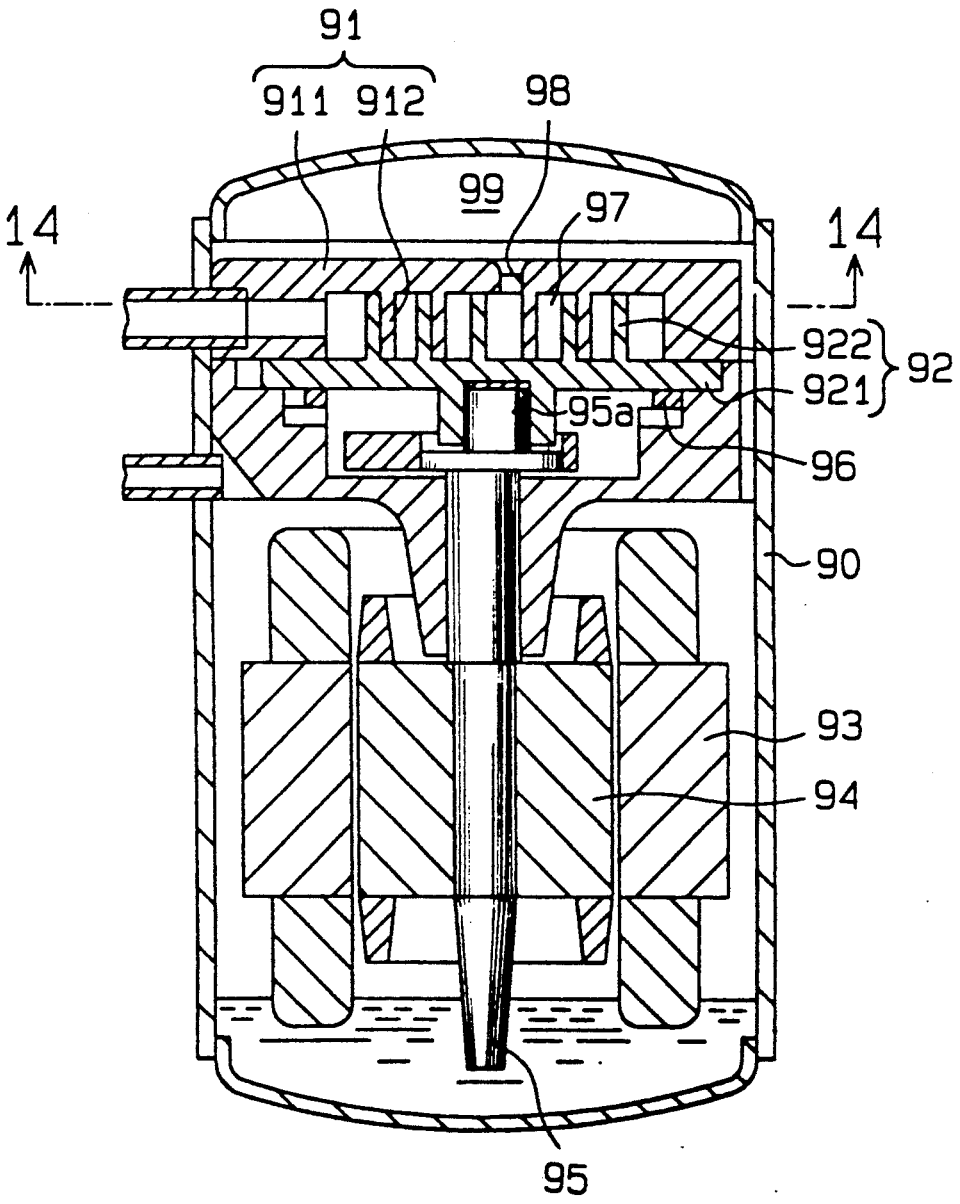
Fig. 13 (PRIOR ART)
FIG. 13 is a longitudinal cross section of a conventional scroll type compressor.
Figure 14:
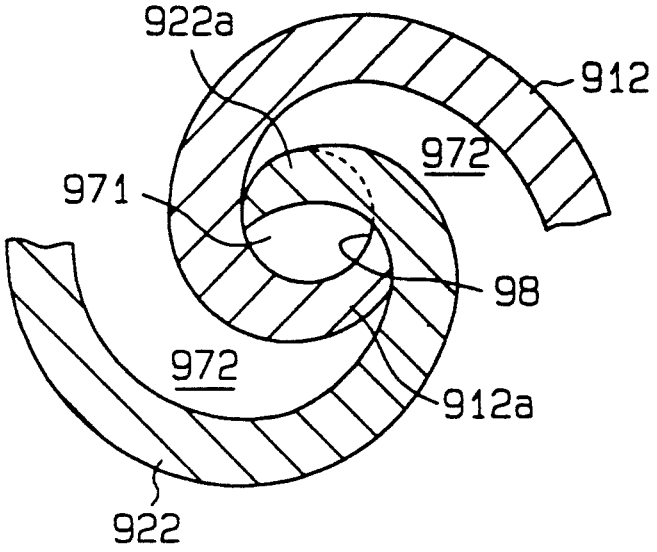
Fig. 14 (PRIOR ART)
FIG. 14 is a cross-sectional view of essential portions illustrating fixed and orbiting scrolls taken along the line 14—14 in FIG. 13.
Figure 15:
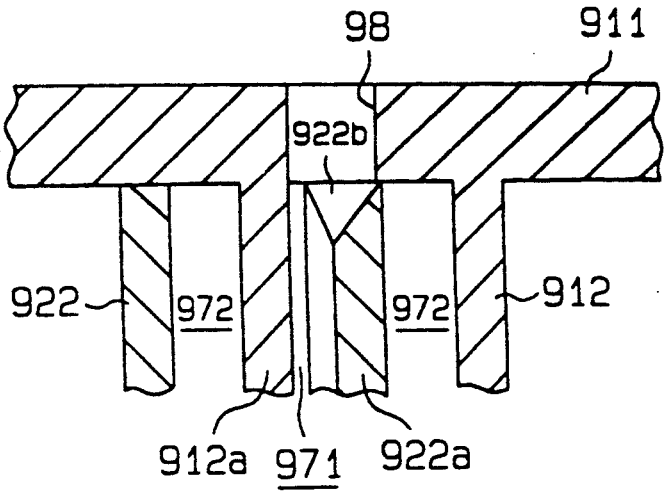
Fig. 15 (PRIOR ART)
FIG. 15 is a cross-sectional view of essential portions illustrating the fixed and orbiting scrolls in the state shown in FIG. 14.

Although only two embodiments of the present invention have been described herein, it should be apparent to those skilled in the art that the present invention may be embodied in many other specific forms without departing from the spirit or scope of the invention. Particularly, it should be understood that this invention may be worked in the form as shown in FIG. 12.

In this modification, two short oval discharge holes 17A and 17B are provided in the fixed end plate 12 in place of the discharge port 16 having a single elongated oval as provided in the second embodiment. Alternatively, a plurality of substantially circular discharge holes may be provided. These discharge holes 17A and 17B are arranged so that a common tangent E to the individual circles defining the outlines of the discharge holes 17A and 17B is parallel to the flat face 13*a* of the fixed spiral element 13. In this case, the number of the discharge holes may be increased, and such a structure may also be applied to the first embodiment. The plurality of side by side discharge holes form an effectively elongated discharge port.

The present examples and embodiments are to be considered as illustrative and not restrictive and the invention is not to be limited to the details given herein, but may be modified within the scope of the appended claims.

What is claimed is:

1. A scroll type compressor comprising:

a fixed scroll including a fixed end plate and a fixed spiral element bounded by radially inner and outer walls joined to said fixed end plate perpendicularly thereto and extending longitudinally along a spiral path terminating in an inner radially widened fixed tip portion, said inner wall having a flat face region at said fixed tip portion;

an orbiting scroll including an orbiting end plate and an orbiting spiral element joined to said orbiting end plate perpendicularly thereto and extending longitudinally along a spiral path terminating in an inner radially widened orbiting tip portion, said orbiting tip portion having a radially inner wall with an orbiting flat face region disposed to face said fixed tip flat face region and to extend from said orbiting end plate normal thereto toward an edge where said orbiting flat face region joins a beveled region;

said orbiting scroll being mounted for orbital revolving movement relative to said fixed scroll with said fixed and orbiting spiral elements interleaved such that said flat faces of said fixed and orbiting tip portions are periodically positioned adjacent each other during revolution of said orbiting scroll;

at least one airtight compression chamber formed between said fixed scroll and said orbiting scroll; and at least one oblong discharge port formed through said fixed end plate adjacent said flat face region of said fixed spiral element;

said beveled surface region cooperating with said fixed scroll flat face region when said flat face regions come together to provide a fluid passage communicating with said discharge port.

2. A scroll type compressor according to claim 1, wherein said oblong discharge port has two flat side walls that extend substantially in parallel with said flat face region of said fixed spiral element.

3. A scroll type compressor according to claim 2, wherein one of said flat side walls of said discharge port is positioned as an extension of said flat face region of said fixed spiral element.

4. A scroll type compressor according to claim 2, wherein said discharge port is slightly spaced apart from said flat face of said fixed spiral element to form a step between said flat face of said fixed spiral element and one of said flat side walls of said discharge port.

5. A scroll type compressor according to claim 1 wherein the length of said beveled region is substantially the same as the length of said discharge port.

6. A scroll type compressor according to claim 1, wherein there are a plurality of said oblong discharge ports formed through said fixed end plate and arranged such that a common tangent to the perimeter of each of said discharge ports is substantially parallel to said flat face region of said fixed spiral element.

7. A scroll type compressor according to claim 6 wherein said discharge ports are substantially oval in shape.

8. A scroll type compressor comprising:

a fixed scroll including a fixed end plate and a fixed spiral element bounded by radially inner and outer walls joined to said fixed end plate perpendicularly thereto and extending longitudinally along a spiral path terminating in an inner radially widened fixed tip portion, said inner wall having a flat face region substantially perpendicular to said fixed end plate at said fixed tip portion;

an orbiting scroll including an orbiting end plate and an orbiting spiral element joined to said orbiting end plate perpendicularly thereto and extending longitudinally along a spiral path terminating in an inner radially widened orbiting tip portion, said orbiting tip portion having a radially inner wall with an orbiting flat face region disposed to face said fixed tip flat face region and to extend from said orbiting end plate normal thereto toward an edge where said orbiting flat face region joins a beveled region;

said orbiting scroll being mounted for orbital revolving movement relative to said fixed scroll with said fixed and orbiting spiral elements interleaved such that said flat faces of said fixed and orbiting tip portions are periodically positioned adjacent each other during revolution of said orbiting scroll;

at least one airtight compression chamber formed between said fixed scroll and said orbiting scroll;

at least one oblong discharge port formed through said fixed end plate adjacent said flat face region of said fixed spiral element, said port having a flat side wall that is aligned with said flat face region of said fixed spiral element;

said beveled surface region cooperating with said fixed scroll flat face region when said flat face regions come together to provide a fluid passage interconnecting said compression chamber with said discharge port when said flat face regions of both spiral elements are in closest proximity; and a drive mechanism for revolving said orbiting scroll relative to said fixed scroll to decrease the volume of said compression chamber to compress fluid in said chamber.

9. A scroll type compressor according to claim 8, wherein said oblong discharge port has two flat side walls that extend substantially in parallel with said flat face region of said fixed spiral element.

10. A scroll type compressor according to claim 8, wherein there are a plurality of said oblong discharge ports formed through said fixed end plate and arranged such that a common tangent to the perimeter of each of said discharge ports is substantially parallel to said flat face region of said fixed spiral element.

11. A scroll type compressor comprising:

a fixed scroll including a fixed end plate and a fixed spiral element bounded by radially inner and outer walls joined to said fixed end plate perpendicularly thereto and extending longitudinally along a spiral path terminating in an inner radially widened fixed tip portion, said inner wall having a flat face region substantially perpendicular to said fixed end plate at said fixed tip portion;

an orbiting scroll including an orbiting end plate and an orbiting spiral element joined to said orbiting end plate perpendicularly thereto and extending longitudinally along a spiral path terminating in an inner radially widened orbiting tip portion, said orbiting tip portion having a radially inner wall with an orbiting flat face region disposed to face said fixed tip flat face region and to extend from said orbiting end plate normal thereto toward an edge where said orbiting flat face region joins a beveled region;

said orbiting scroll being mounted for orbital revolving movement relative to said fixed scroll with said fixed and orbiting spiral elements interleaved such that said flat faces of said fixed and orbiting tip portions are periodically positioned adjacent each other during revolution of said orbiting scroll;

at least one airtight compression chamber formed between said fixed scroll and said orbiting scroll;

at least one discharge port formed through said fixed end plate for discharging fluids from said compression chamber, said discharge port being located at a position slightly spaced from said flat face region of said fixed spiral element with a step formed between said flat face region of said fixed spiral element and a proximal wall of said discharge port, said discharge port having an oblong cross-section with its long axis substantially parallel to said flat face region of said fixed spiral element;

said beveled surface region cooperating with said fixed scroll flat face region when said flat face regions come together to provide a fluid passage interconnecting said compression chamber with said discharge port when said flat face regions of both spiral elements are in closest proximity; and a drive mechanism for revolving said orbiting scroll relative to said fixed scroll to decrease the volume of said compression chamber to compress fluid in said chamber.

12. A scroll type compressor according to claim 11, wherein said oblong discharge port has two flat side walls that extend substantially in parallel with said flat face region of said fixed spiral element.

13. A scroll type compressor according to claim 11, wherein there are a plurality of said oblong discharge ports formed through said fixed end plate and arranged such that a common tangent to the perimeter of each of said discharge ports is substantially parallel to said flat face region of said fixed spiral element.

* * * * *